US011148036B2

(12) United States Patent
Chen et al.

(10) Patent No.: US 11,148,036 B2
(45) Date of Patent: Oct. 19, 2021

(54) MULTI-LINK WHEEL BASE AND APPLICATIONS THEREOF

(71) Applicants: Yongmei Chen, Ningbo (CN); Yongping Chen, Ningbo (CN)

(72) Inventors: Yongmei Chen, Ningbo (CN); Yongping Chen, Ningbo (CN)

( * ) Notice: Subject to any disclaimer, the term of this patent is extended or adjusted under 35 U.S.C. 154(b) by 90 days.

(21) Appl. No.: 16/608,197

(22) PCT Filed: Jun. 25, 2019

(86) PCT No.: PCT/CN2019/092652

§ 371 (c)(1),
(2) Date: Oct. 25, 2019

(87) PCT Pub. No.: WO2020/001414

PCT Pub. Date: Jan. 2, 2020

(65) Prior Publication Data

US 2021/0146230 A1 May 20, 2021

(30) Foreign Application Priority Data

Jun. 26, 2018 (CN) ..... 201810668845.6

(51) Int. Cl.

| | |
|---|---|
| ***A63C 17/01*** | (2006.01) |
| ***A63C 17/00*** | (2006.01) |
| ***A63C 17/02*** | (2006.01) |
| ***A63C 17/14*** | (2006.01) |
| ***A63C 17/22*** | (2006.01) |

(52) U.S. Cl.

CPC ..... *A63C 17/015* (2013.01); *A63C 17/0046* (2013.01); *A63C 17/013* (2013.01); *A63C 17/02* (2013.01); *A63C 17/1418* (2013.01); *A63C 17/226* (2013.01); *A63C 2017/1463* (2013.01); *A63C 2203/42* (2013.01)

(58) Field of Classification Search

CPC . A63C 17/0046; A63C 17/013; A63C 17/262; A63C 17/015; A63C 2203/42

See application file for complete search history.

(56) References Cited

U.S. PATENT DOCUMENTS 5,342,071 A * 8/1994 Soo ..... A63C 17/0046 280/11.207
6,045,142 A * 4/2000 Andrich ..... A63C 17/0046 280/11.221

(Continued)

FOREIGN PATENT DOCUMENTS

CN 203852822 U 10/2014
CN 104606871 A 5/2015

(Continued)

*Primary Examiner* — Brian L Swenson

(74) *Attorney, Agent, or Firm* — Bayramoglu Law Offices LLC

(57) ABSTRACT

A multi-link wheel base includes a main body composed of a plurality of links connected in series and wheels provided on the main body, and the wheels are provided on the link assembly the link assembly includes an intermediate link and an end link, wherein both sides of the intermediate link are provided with a rotational connection position, one side of the end link is provided with a rotational connection position, and the rotational connection positions on the adjacent link assemblies are rotationally connected by means of a connecting device.

16 Claims, 10 Drawing Sheets

(56) References Cited

U.S. PATENT DOCUMENTS

| | | | | |
|---|---|---|---|---|
| 6,478,313 | B1 | 11/2002 | Gray | |
| 6,561,525 | B1 * | 5/2003 | Chou | A63C 17/0046 280/11.215 |
| 6,644,673 | B2 * | 11/2003 | Longino | A63C 17/0046 280/11.215 |
| 7,735,841 | B1 * | 6/2010 | Longino | A63C 17/062 280/11.28 |
| 9,573,045 | B2 * | 2/2017 | Lai | A63C 17/014 |
| 2001/0006282 | A1 | 7/2001 | Green et al. | |
| 2002/0105150 | A1 * | 8/2002 | Liao | A63C 17/0046 280/11.223 |
| 2009/0045596 | A1 * | 2/2009 | Boucher | A63C 17/062 280/11.223 |
| 2016/0038824 | A1 * | 2/2016 | Choudhary | A63C 17/062 280/11.207 |
| 2018/0028899 | A1 * | 2/2018 | Chen | A63C 17/02 |

FOREIGN PATENT DOCUMENTS

| | | | |
|---|---|---|---|
| CN | 205796460 | U | 12/2016 |
| CN | 108905178 | A | 11/2018 |
| KR | 20120069623 | A | 6/2012 |
| WO | 0112278 | A1 | 2/2001 |

* cited by examiner

MULTI-LINK WHEEL BASE AND APPLICATIONS THEREOF

CROSS REFERENCE TO THE RELATED APPLICATION

This application is the national phase entry of International Application No. PCT/CN2019/092652 filed on Jun. 25, 2019, which is based upon and claims priority to Chinese Patent Application No. 201810668845.6, filed on Jun. 26, 2018, the entire contents of which are incorporated herein by reference.

TECHNICAL FIELD

The invention belongs to the field of outdoor sports equipment, in particular, to a multi-link wheel base, and the invention also relates to the application of the wheel base on various sports equipment.

BACKGROUND

With the improvement of people's quality of life, more and more young people will thy and be keen on outdoor sports, such as roller skating, skateboarding, scooters, etc., so as to do exercise and achieve good social goals. In outdoor sports equipment such as roller skates, skateboards, and scooters, the wheel base is in contact with the ground to achieve the purpose of sports. Our original design of the link structure can only be mechanically moved up and down, so this kind of movement can be carried out on uneven roads, but the original design does not have all-round steering ability so that the adaptability and comfort for this product structure are not strong.

At present, most wheel bases are of fixed mounting structures or link structures. When advancing on an undulating road with obstacles or pits, although the original design also has a certain off-road capability, but the links can only move up and down simply, and cannot rotate in all directions; when passing through a complicated road surface, some of the wheels will be suspended, and the fixed bracket and the product thereon cannot be omnidirectionally steered so that the wheels cannot all be attached to the ground. Therefore, designs on comfort and safety are not sufficient.

In addition, for the purpose of safely and gently passing the undulating road surface, the wheels in the base of the existing product are also designed to be a structure capable of moving up and down. But even like this, the wheels only have degrees of freedom in the up and down direction, and handling cannot be performed well when complicated road conditions are encountered. Moreover, the wheel base designed by such a link has a situation in which the wheel is suspended when it encounters a deep pit on the road surface so that the stability is poor. Therefore, for some bases provided for the wheels, if they can have rotational degrees of rotation in multiple directions, the stability will be better.

Based on the above, the present invention has further studied the wheel base.

SUMMARY

In view of the above deficiencies in the prior art, the present invention provides a link structure in which a multi-link wheel base may be connected in series. The wheel bases with different lengths may be assembled as required, wherein each joint may rotate in all directions without dead angles so as to solve the problem of mutual restraint between the links after the series connection. And each wheel may be attached to the ground, the bracket and the upper products may also be rotated in all directions to adapt to complex road conditions so that the performance of shock absorbing and cushioning is good. At the same time, the main body adopts a splicing structure, which may be assembled as required and facilitates operation. In addition, the invention also relates to the application of the wheel base on some sports equipment.

In order to solve the said technical problems, the present invention uses following technical solutions to solve those.

Provided is a Multi-link wheel base comprising a main body composed of a plurality of link assemblies that are rotationally coupled together and wheels provided on the main body, and the wheels are provided on the link assembly; the link assembly includes an intermediate link and an end link, wherein both sides of the intermediate link are provided with a rotational connection position, one side of the end link is provided with a rotational connection position, and the rotational connection positions on the adjacent link assemblies are rotationally connected in omni-directions by means of a connecting device.

The main body bracket of the traditional wheel base is generally an integrated structure, or a simple mechanical link structure that can only move up and down, which lacks plasticity, has poor cushioning and shock absorbing ability, and cannot perform omni-directional rotations of the links that are connected in series. In the multi-link wheel base of the present invention, the assembled link assemblies that are connected in series are assembled into a main body so that different number of link assemblies can be selected according to requirements, and bodies of different lengths can be assembled so as to facilitate the modular operation. At the same time, most importantly, the connected link assemblies of the present invention are connected by a connecting device, and can be rotated up and down or laterally, thereby achieving an omni-directional independent rotation in the three-dimensional space. Therefore, the wheel base has a strong ability to overcome obstacles and all terrain adaptability. When encountering a bumpy road surface, the wheel can be completely attached to the ground according to the terrain so that the stability is good, and the rotating connection between the link assemblies also makes the whole body have good shock absorbing ability. The multi-link series-connected structure and the omni-directionally rotated joint structure enable the wheels to have the ability to attach to the ground in all terrain, and the wheels do not drop rapidly, so that the safety is high and the adaptability is strong.

Preferably, the rotational connection position includes a plug-in connection position as an insertion portion and a window connection position for receiving the plug-in connection position; the plug-in connection position and the window connection position are provided with a first through hole and a second through hole that are aligned with each other; the connecting device is assembled in the first through hole and the second through hole to achieve a rotational connection of the adjacent link assemblies. The adjacent link assemblies are aligned by the plug-in connection position and the window connection position for assembly and fixing so as to facilitate the operation.

Preferably, the connecting device includes an assembly body provided in the second through hole and a connecting shaft provided in the assembly body, and further includes a spherical rotating body provided in the first through hole, the connecting shaft penetrating the spherical rotating body. The arrangement of the spherical rotating body causes a lateral rotation space between the connected link assemblies, so that the road surface may be adapted to perform lateral swinging when the pit is paved so as to reduce vibration.

Preferably, the spherical rotating body is provided with a rotating bead and the connecting shaft penetrates the rotating bead. The rotating bead functions like a ball shaft, and may generate various angular rotations in the direction of the connecting shaft, so that the link assembly may be rotated in all directions with a high degree of freedom.

Preferably, the assembly body is an elastomer to provide a shock absorbing effect.

Preferably, the main body is further provided with a plurality of fixing devices for connecting including a mounting hole provided on the main body, the spherical rotating body provided in the fixing hole and the connecting shaft penetrating the spherical rotating body. The wheel base and the functional assemblies thereon (such as roller skates, skateboards, etc.) are fixed by the connecting shaft or its attached structure, and can be rotated in all directions after being fixed, and then the omnidirectional rotation may be realized by means of a principle that is the same as that of the omnidirectional rotation generated between adjacent link assemblies while having an overall degree of freedom and a good shock absorbing effect.

Preferably, the main body is further provided with a plurality of fixing devices for connecting including a mounting hole provided on the main body; the mounting hole is provided inside with a ball shaft assembly and a connecting shaft in the ball shaft assembly protrudes upward. In this structure, the wheel base is fixed with the functional assemblies thereon (such as roller shoes, skateboards, etc.) by the connecting shaft, and then the arrangement of the ball shaft enables the deflection between the functional assembly and the base in various directions at a certain angle, so that the overall degree of freedom is high and the shock absorbing effect is good.

Preferably, the ball shaft assembly includes a base, a ball shaft provided in the base and a positioning sleeve sleeved on the ball shaft, a connecting shaft on the ball shaft protrudes from the positioning sleeve.

Preferably, the upper surface of the positioning sleeve is provided with a positioning hole and the hole diameter of the positioning hole in the advancing direction of the main body is smaller than the hole diameter in the direction of both sides of the main body. The structure makes the deflection angle of the fixed functional assembly in the left and right directions large so as to comply with normal usage habits of people.

The multi-link wheel base of the present invention is mounted on most of the sports equipment using the wheel base as needed, and may be one or more of the following applications: an application that the multi-link wheel base is used as the roller shoe base, an application that the multi-link wheel base is used as the skateboard base, an application that the multi-link wheel base is used as the scooter base, an application that the multi-link wheel base is used as the swing racer base.

Compared with prior art, the present invention has the following beneficial effects: a multi-link wheel base is provided, which is assembled by using a plurality of link assemblies, may be assembled into different lengths of wheel bases according to requirements, and the link assemblies are rotatably connected in a plurality of directions with a degree of freedom of rotation, a good cushioning and a high stability, especially suitable for advancing on uneven roads.

DETAILED DESCRIPTION OF THE EMBODIMENTS

Figure 1:
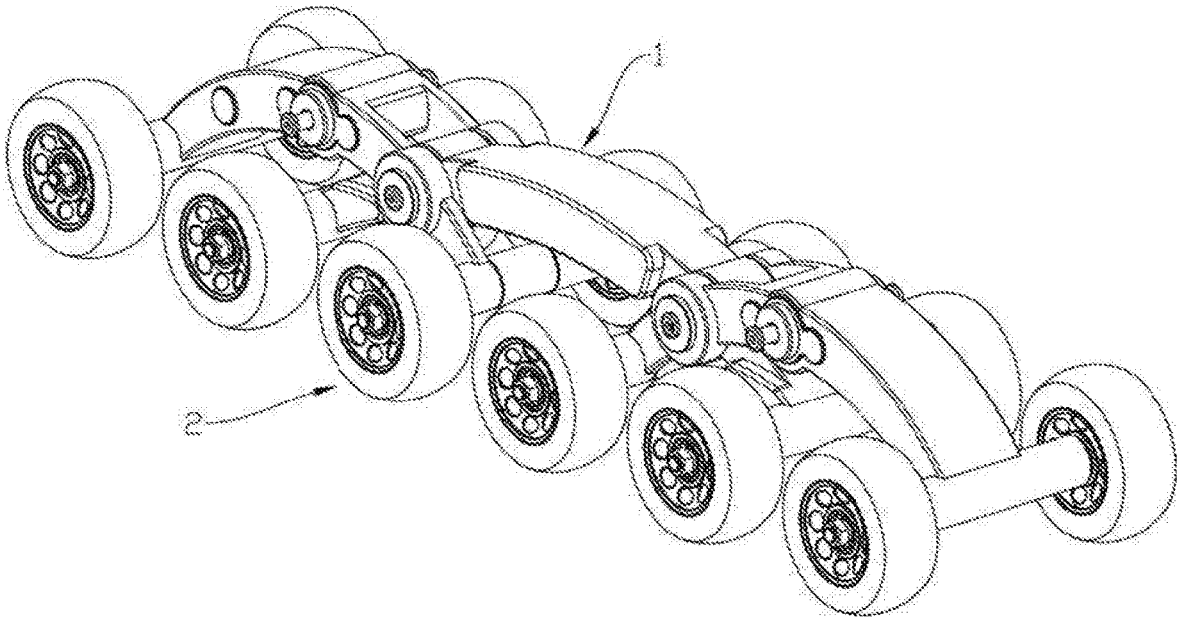
FIG. 1 is a perspective view of a three-link wheel base in the present invention.
Figure 2:
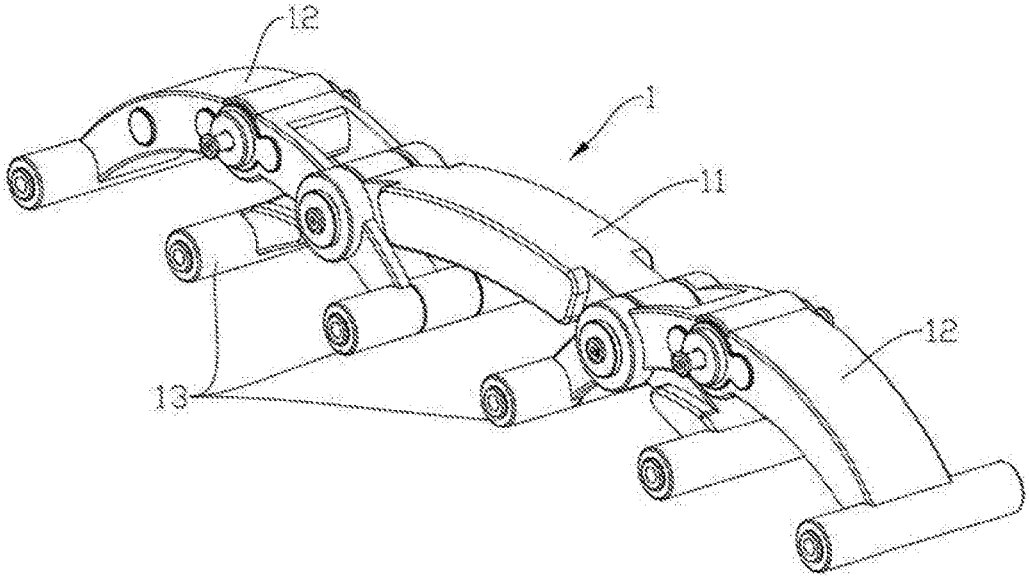
FIG. 2 is a perspective view of a three-link main body in the present invention.
Figure 3:
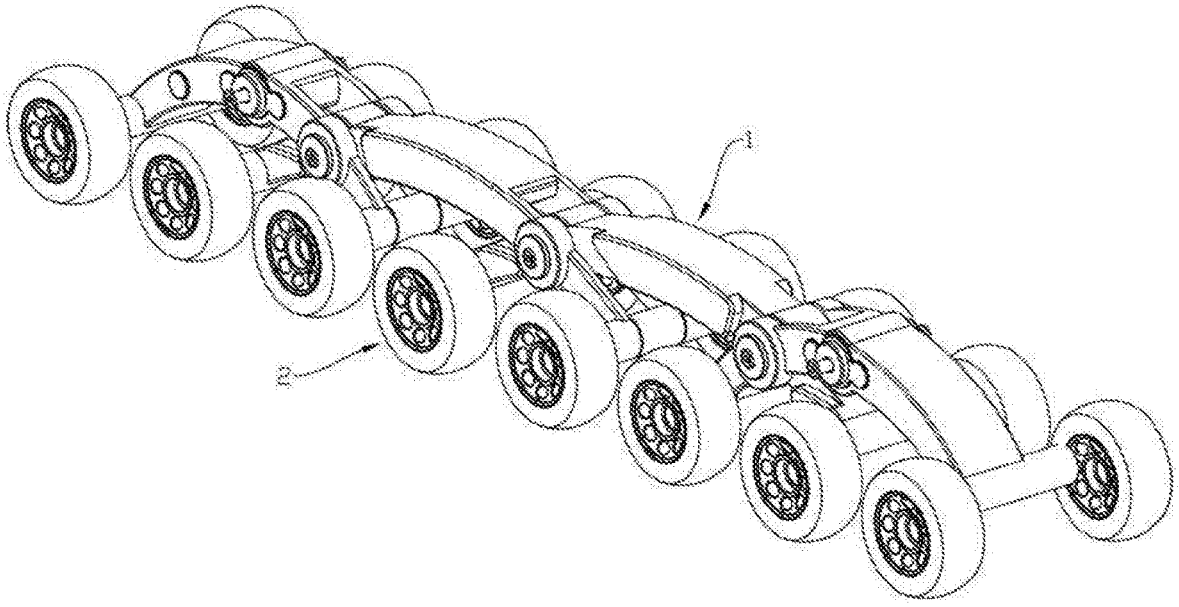
FIG. 3 is a perspective view of a four-link wheel base in the present invention.
Figure 4:
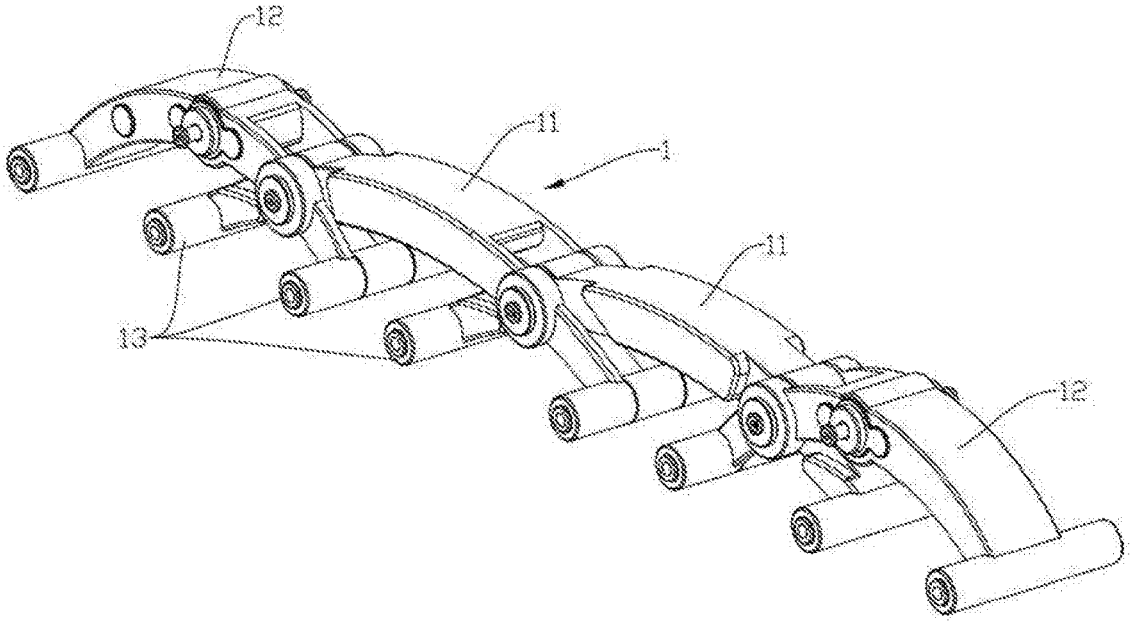
FIG. 4 is a perspective view of a four-link main body in the present invention.

The present invention will be further described in detail in combination with drawings and specific embodiments.

With reference to FIGS. 1 to 22, a multi-link wheel base of the present invention comprises a main body 1 and wheels 2 provided on the main body 1; the main body 1 is composed of joints that are movable in all directions and a plurality of link assemblies that are connected together, and the wheels 2 are provided on a wheel mounting structure 13 at both ends of the link assembly, the wheel mounting structure 13 and the wheels 2 being technologies in a conventional structure; the link assembly includes an intermediate link 11 and an end link 12, wherein both sides of the intermediate link 11 are provided with rotational connection positions that are free in all directions at both sides, one side of the end link 12 is provided with a rotational connection position that is free in all directions, and the rotational connection positions on the adjacent link assemblies are rotationally connected by means of a connecting device. The structure allows the linkage assembly to be assembled as desired, as shown in FIGS. 1-4, which are the bases of the three link assemblies and the bases of the four link assemblies.

Figure 5:
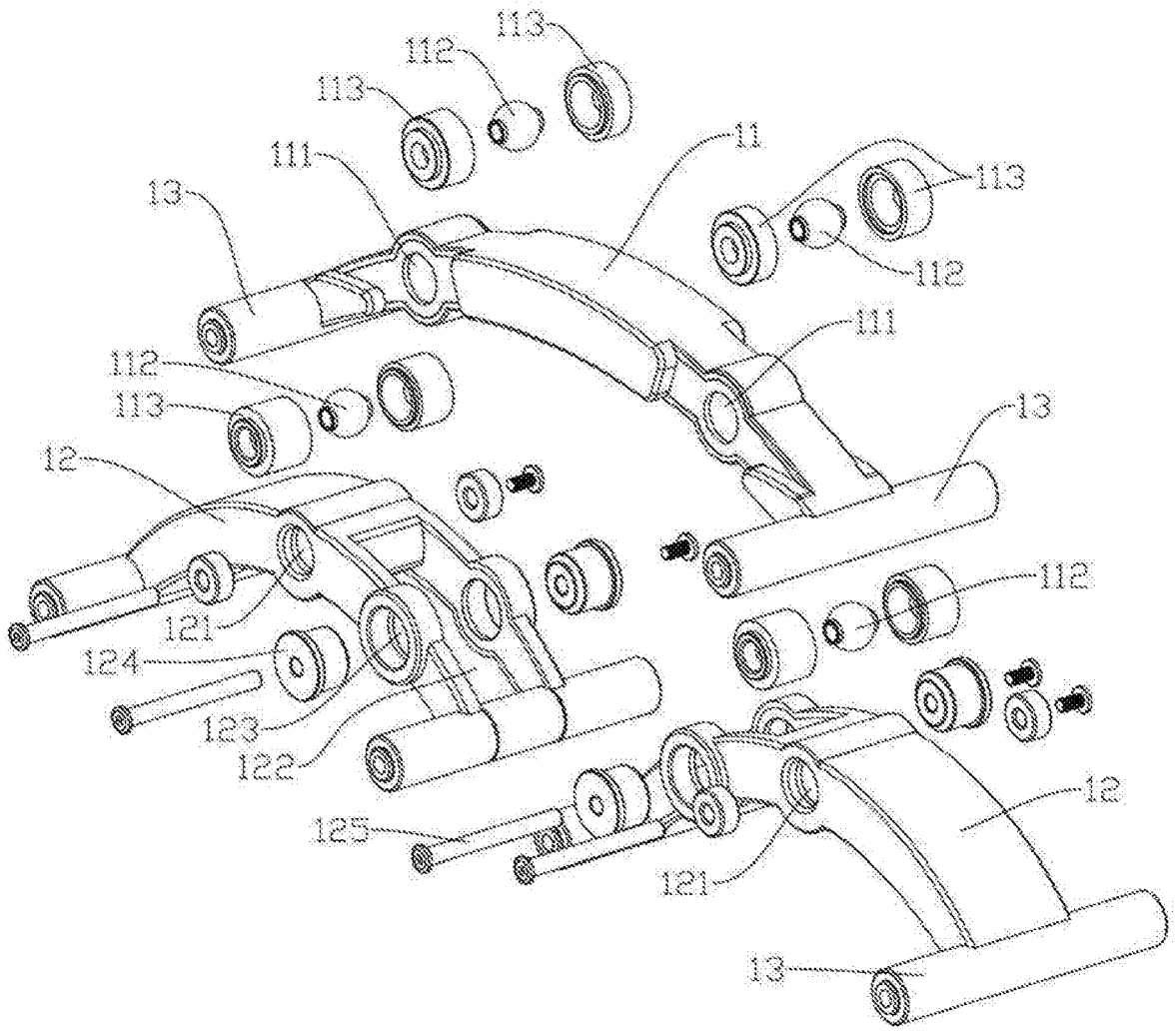
FIG. 5 is a view showing the exploded state of the three-link main body in the present invention.
Figure 6:
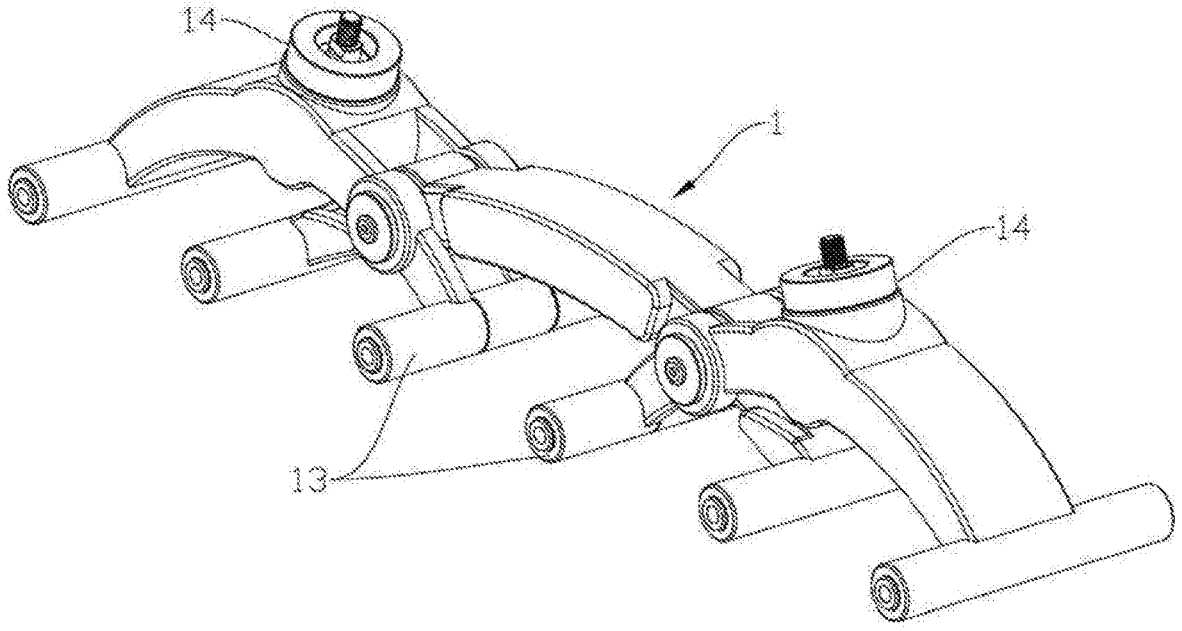
FIG. 6 is a perspective view of the main body in another embodiment.
Figure 7:
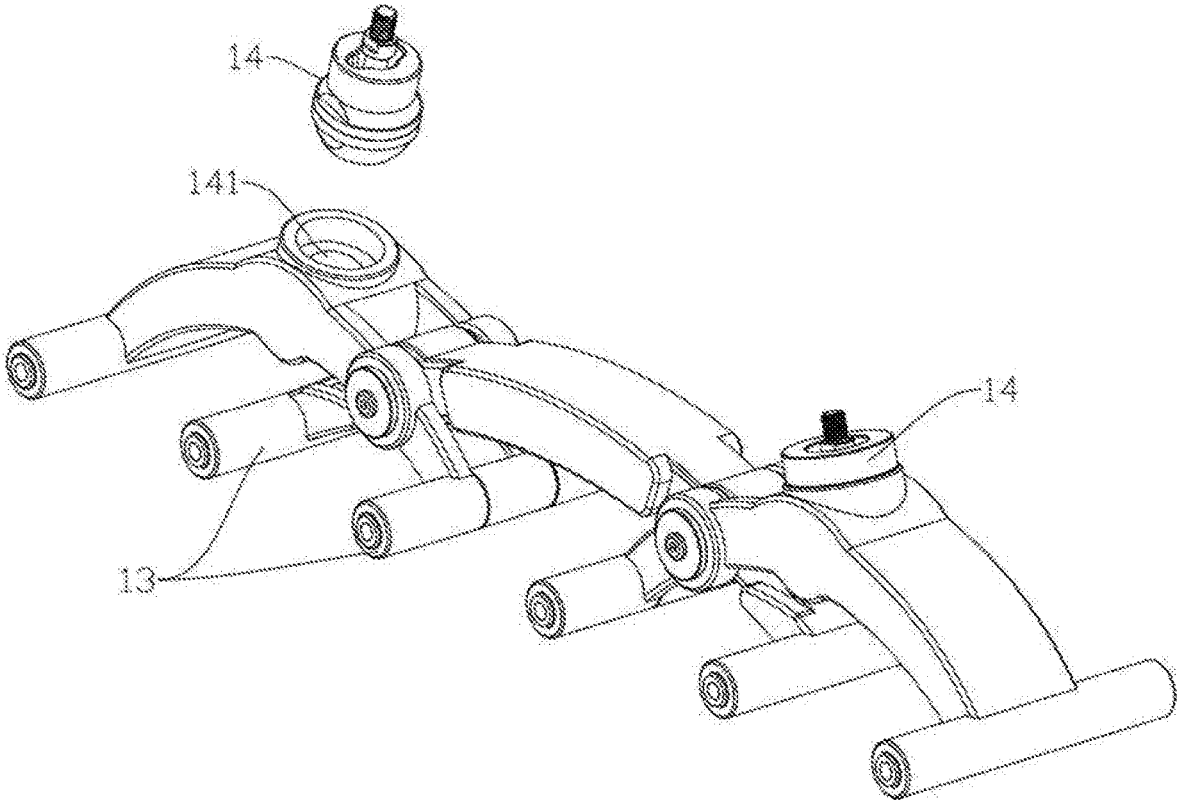
FIG. 7 is a partial assembled view of the main body of FIG. 6.
Figure 8:
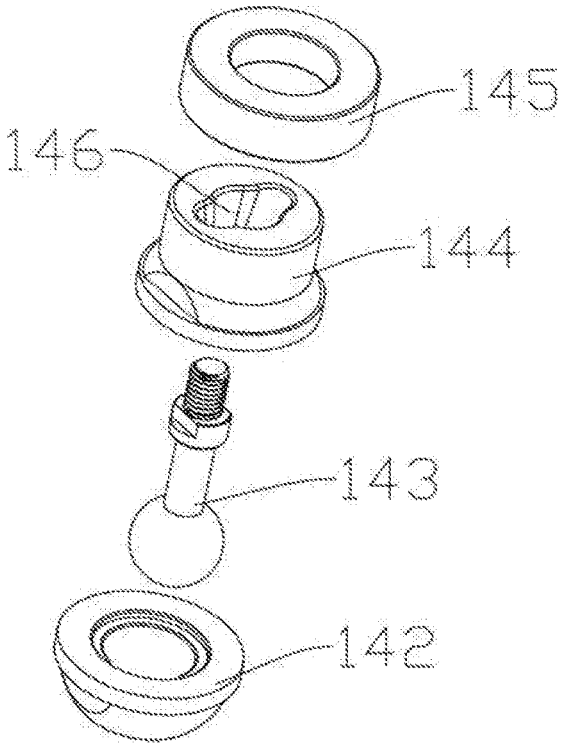
FIG. 8 is an exploded view of the ball shaft assembly of FIG. 7.
Figure 9:
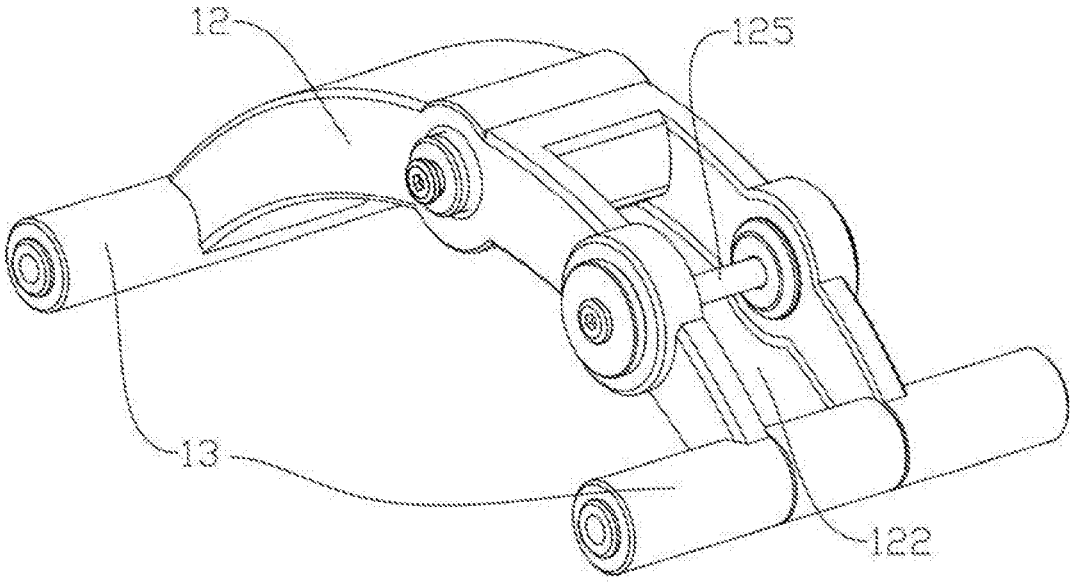
FIG. 9 is a view of one of the end links in the present invention.

Specifically, the rotational connection position includes a plug-in connection position as an insertion portion and a window connection position for receiving the plug-in connection position (the window connection position is provided with a window 122 for inserting the plug-in connection position); the plug-in connection position and the window connection position are provided with a first through hole 111 and a second through hole 123 that are aligned with each other; the connecting device is assembled in the first through hole 111 and the second through hole 123 to achieve a rotational connection of the adjacent link assemblies; the plug-in connection position and the window connection position are respectively provided on the adjacent link assemblies for connection with the setting may performed as required. As shown in FIG. 5, both ends of the intermediate link 11 are plug-in connection positions and the end link 12 has winnow-type connection positions so that a matching assembly is achieved, or both ends of the intermediate link 11 are window connection positions and the end link 12 has plug-in connection positions so that the assembly is also be achieved; or both ends of the intermediate link 11 are respectively a window connection position and a plug-in connection position, and two end links 12 have respectively a window connection position and a plug-in connection position so that the assembly is also achieved. All of above falls within the scope of protection of the present invention. The connecting device includes an assembly body 124 provided in the second through hole 123 and a connecting shaft 125 provided in the assembly body 124; the assembly body 124 is an elastomer; the connecting device penetrates through the connecting shaft 125 of the rotating bead 112 and a casing 113 enclosing the rotating head 112 by providing the second through hole 123 and the first through hole 111 in the assembly body 124 and using the assembly body 124, to obtain the ability of rotating in all directions in joints. The connecting device further includes a spherical rotating body provided in the first through hole 111, the connecting shaft 125 penetrating the spherical rotating body. The spherical rotating body includes a rotating bead 112 therein and the casing 113 enclosing the rotating head 112, the connecting shaft 125 penetrates the rotating bead 112 and the diameter of the hole on the casing 113 through which the connecting shaft 125 passes is larger than the diameter of the connecting shaft 125, so that the rotating bead 112 and the connecting shaft 125 may be rotated in all directions in the casing 113 to provide the link assembly with the ability to rotate up, down, left, and right. The casing 113 shown in the figure is a separate structure, and may also be a structure integrated into the first through hole 111, all falling within the scope of the present invention.

In addition, the main body 1 of the present invention is further provided with a plurality of fixing devices for connecting. In one embodiment, the fixing devices includes a fixing hole 121 provided on the main body 1, an omni-directional spherical rotating body provided in the fixing hole 121 and the connecting shaft 125 penetrating the omni-directional spherical rotating body. The structure of the omni-directional spherical rotating body is the same as that of the omni-directional spherical rotating body of the first through hole 111, and functions to generate an omni-directional rotation of up, down, left, and right. Correspondingly, the fixing hole 121 is also provided with an elastomer, and other functional structures are fixed on the connecting shaft 125 by a connecting plate 4 for fixing. In another embodiment, the connecting device includes a mounting hole 141 provided on the main body 1; the mounting hole 141 is provided inside with a ball shaft assembly 14 and a connecting shaft in the ball shaft assembly 14 protrudes upward; the ball shaft assembly 14 includes a base 142, a ball shaft 143 provided in the base 142 and a positioning sleeve 144 sleeved on the ball shaft 143; a connecting shaft on the ball shaft 143 protrudes from the positioning sleeve 144. In addition, the upper surface of the positioning sleeve 144 is provided with a positioning hole 146 and the hole diameter of the positioning hole 146 in the advancing direction of the main body 1 is smaller than the hole diameter in the direction of both sides of the main body 1, so that the degree of deflection in the left and right direction is large. The positioning sleeve 144 is covered with an elastic sleeve 145, which may withstand the deformation of the extrusion and also generate a return elastic force.

Figure 10:
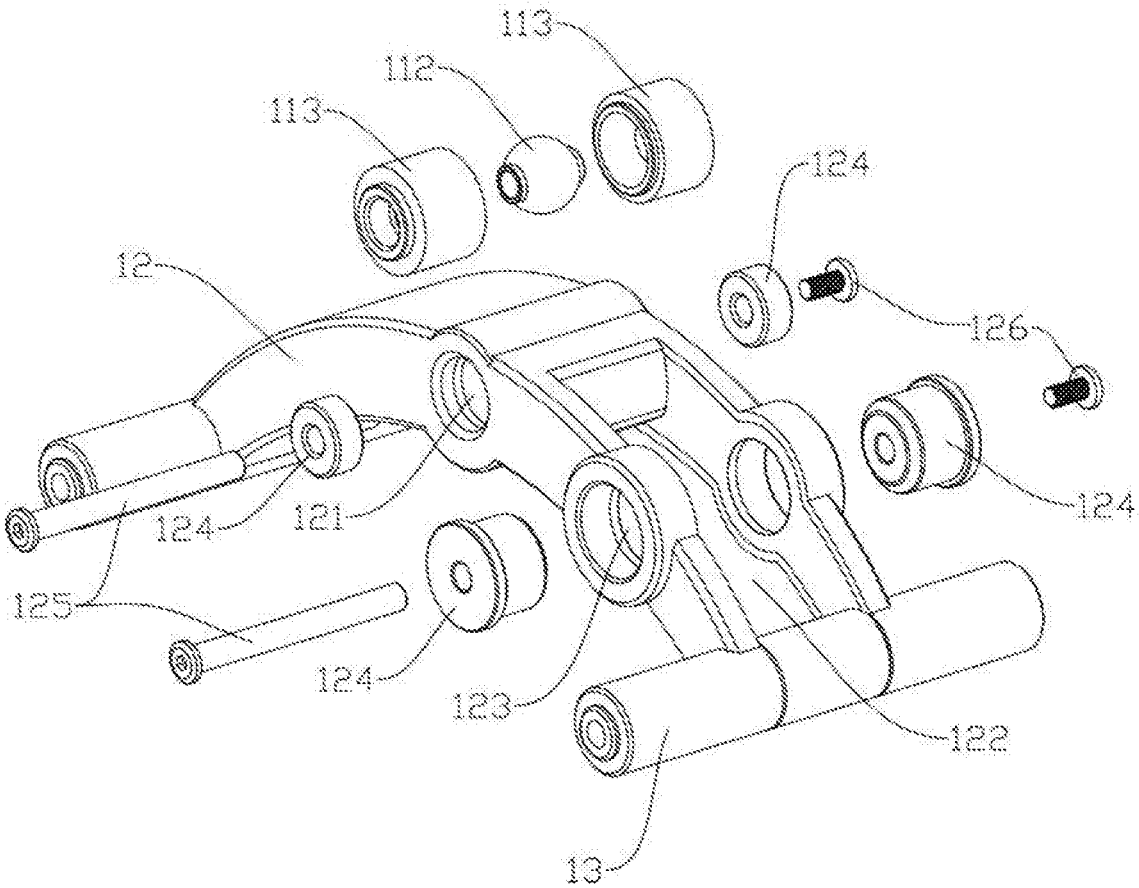
FIG. 10 is an exploded view of the end link of FIG. 9.
Figure 11:
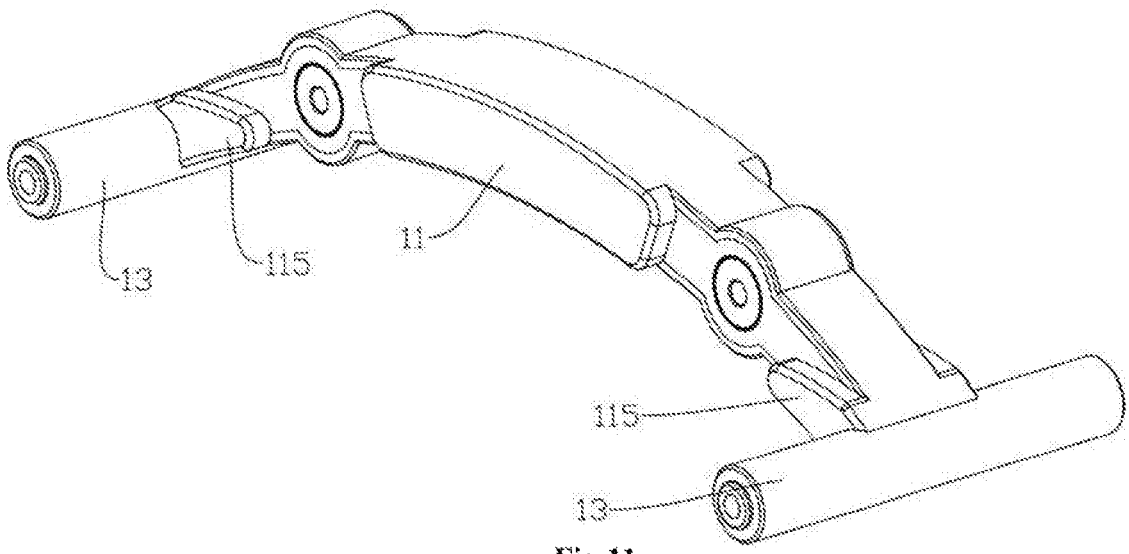
FIG. 11 is a view of one of the intermediate links in the present invention.
Figure 12:
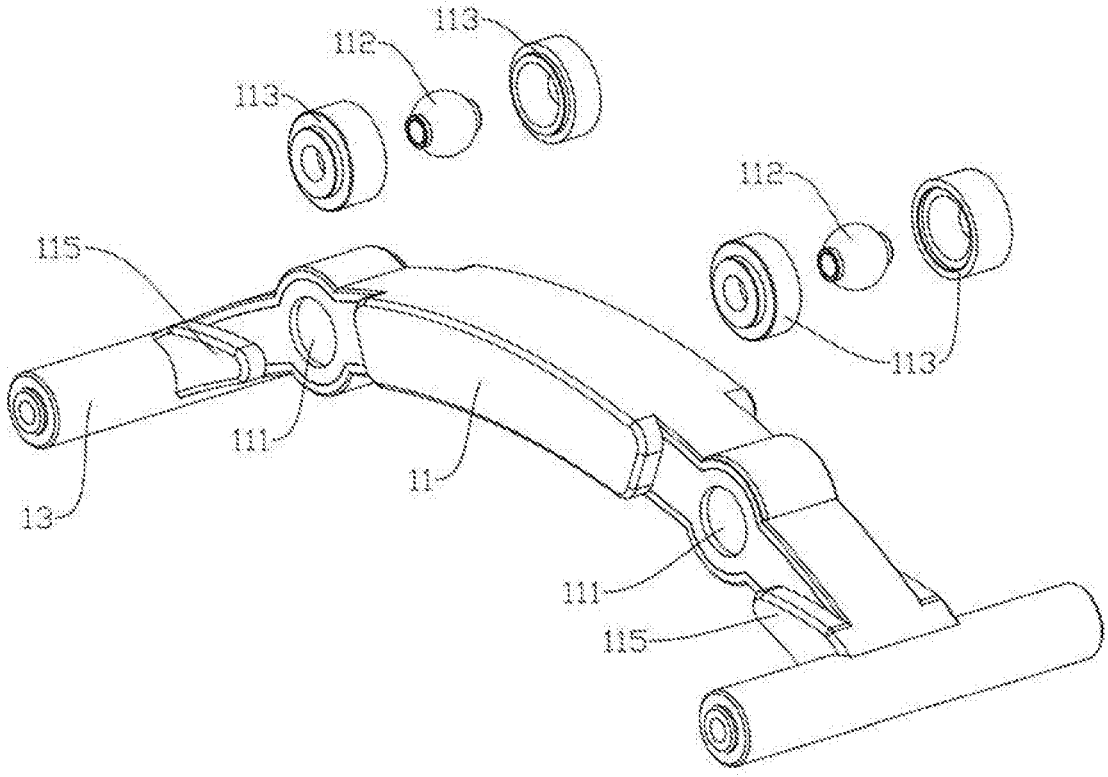
FIG. 12 is an exploded view of the intermediate link of FIG. 11.

In the connection structure in the above structure, the other side having the connection shaft 125 is fixed by a bolt 126, as can be seen from FIG. 10. Further, as can be seen from FIG. 12, a stopper structure 115 is provided at the rotational connection positions on both sides of the intermediate link 11 for preventing the rotationally coupled link assemblies from rotating excessively.

The main body bracket of the traditional wheel base is generally an integrated structure, or a simple mechanical link structure that can only move up and down, which lacks plasticity, has poor cushioning and shock absorbing ability. In the multi-link wheel base of the present invention, the assembled link assemblies are assembled into a main body so that different number of link assemblies can be selected according to requirements, and bodies of different lengths can be assembled so as to facilitate the modular operation. At the same time, most importantly, the connected link assemblies of the present invention are connected by a connecting device, and may be rotated up and down and in all directions, thereby achieving an omni-directional independent rotation in the three-dimensional space. Therefore, it has a strong ability to overcome obstacles and all terrain adaptability. When encountering a bumpy road surface, the wheels may be changed according to the terrain, such as ascending, descending, left tilting, and right tilting, may be completely attached to the ground according to the terrain, so that the wheels do not drop rapidly and the safety is high, the adaptability is strong, and the stability is good.

Figure 13:
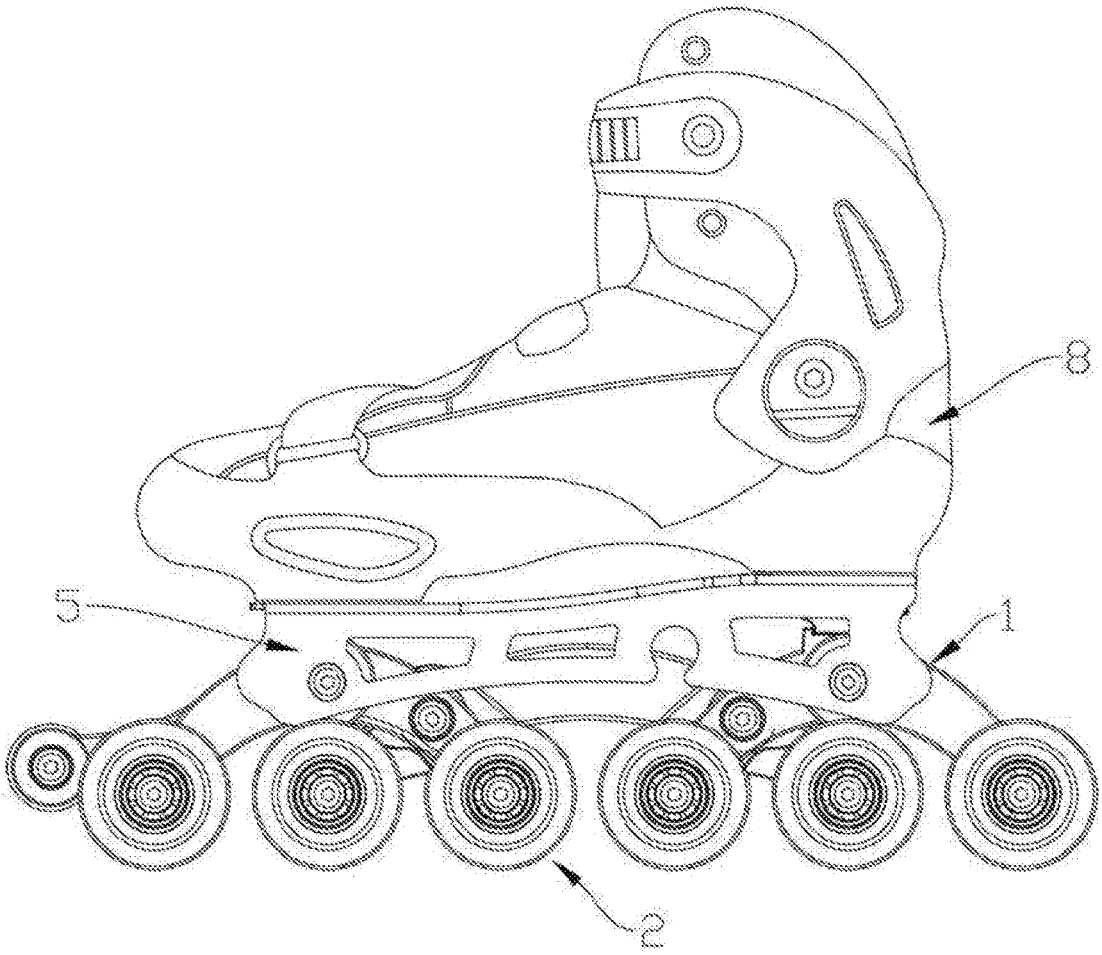
FIG. 13 is a view in which the wheel base of the present invention is used as a base of a roller skate.
Figure 14:
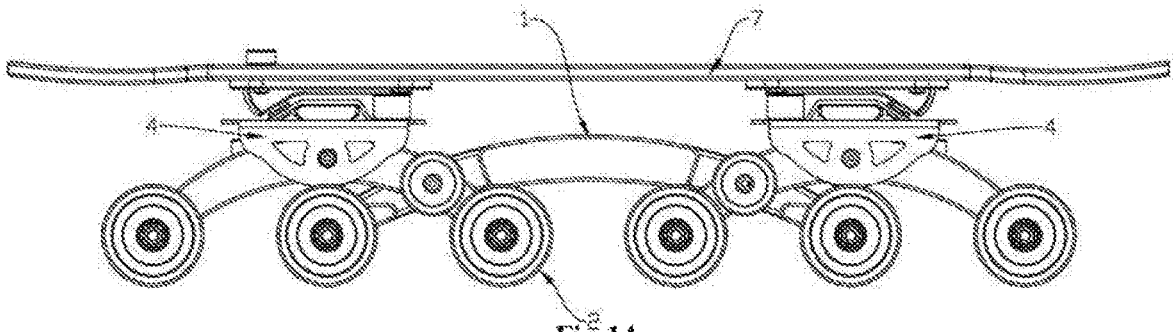
FIG. 14 is a view in which the wheel base of the present invention is used as a base of a skateboard.
Figure 15:
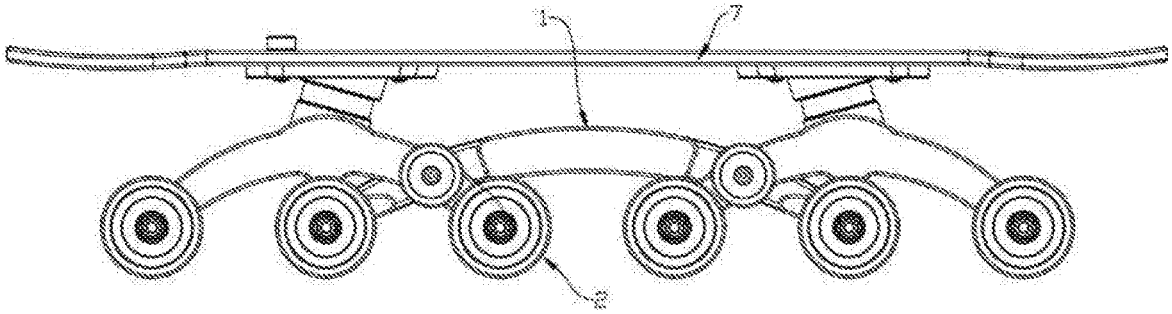
FIG. 15 is a view in which the wheel base in another embodiment of the present invention is used as a base of a skateboard.
Figure 16:
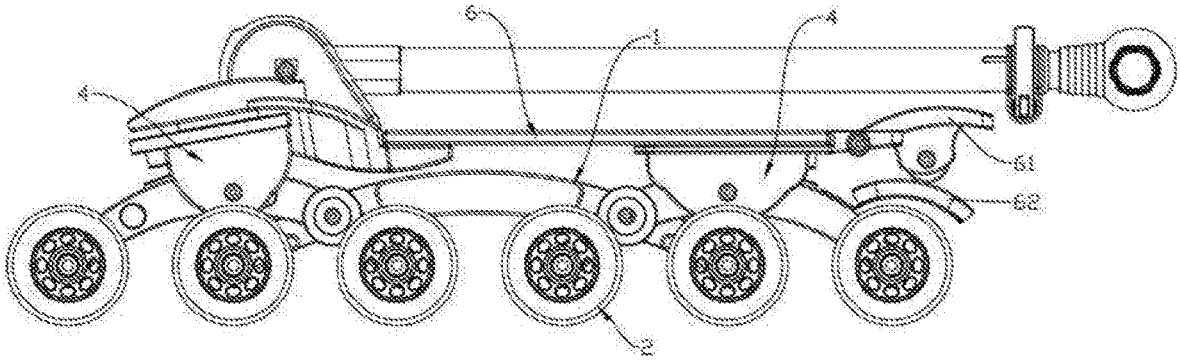
FIG. 16 is a view in which the wheel base of the present invention is used as a base of a scooter.

In addition, the present invention also relates to applications of multi-link wheel base, specifically to one or more of the following applications: (1) an application that the multi-link wheel base is used as the roller shoe base, as shown in FIG. 13, of fixing the shoe body 8 on the wheel base by the sole fixing plate 5; (2) an application that the multi-link wheel base is used as the skateboard base, as shown in FIGS. 14 and 15, has two different connecting devices respectively in FIG. 14 and FIG. 15, wherein for FIG. 14, a skateboard 7 is fixed on the wheel base by a connecting plate 4, and for FIG. 5, the skateboard 7 is fixed on the wheel base by another connecting device; (3) an application that the multi-link wheel base is used as the scooter base, as shown in FIG. 16, of fixing a scooter body 6 on the wheel base by the connecting plate 4; (4) an application that the multi-link wheel base is used as the swing, racer base with the diagram being not shown in the present application.

In above applications, the sports equipment may be allowed to have a good stability and a shock absorption effect when used while having a good safety performance. Moreover, in the application of the scooter, an improvement for a brake structure is also involved, as specifically shown in FIGS. 17-20, and the structure is as follows: the brake structure is provided at the tail of the scooter with the working principle that a pedal member 61 rotates around a second rotating shaft 65 to drive the pressing ball 63 to rotate up and down, left and right along with a brake pad 62 for realizing the braking function; the end of the brake pad 62 is fixed to the end link 12 by a resiliently bent metal piece, and the end of the pedal member 61 is fixed to the scooter by the first rotating shaft 64. In this structure, when a person steps on the pedal member 61 with his or her foot, the brake pad 62 is brought into contact with the wheels 2 by the action of the lower pressing ball 63 and the brake pad 62 to realize the braking.

Figure 17:
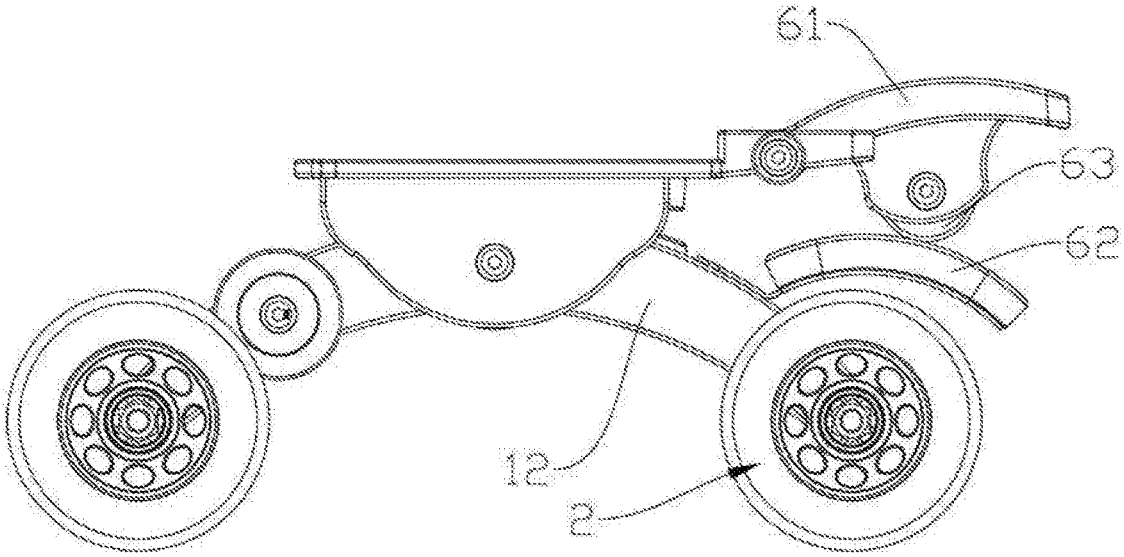
FIG. 17 is a first view of the brake structure of the scooter structure of FIG. 16.
Figure 18:
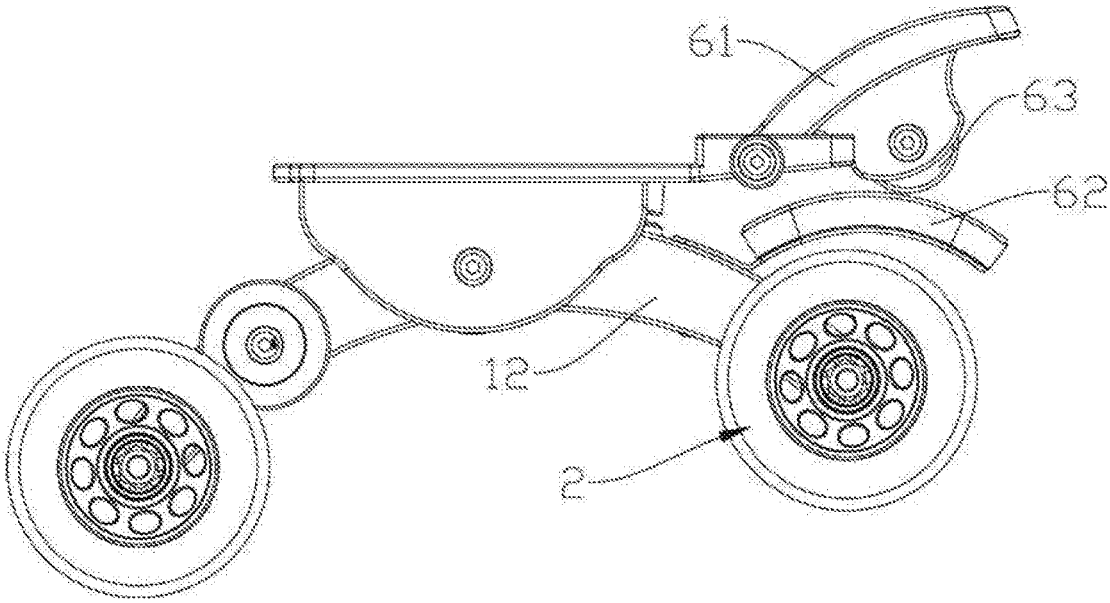
FIG. 18 is a second view of the brake structure of the scooter structure of FIG. 16.
Figure 19:
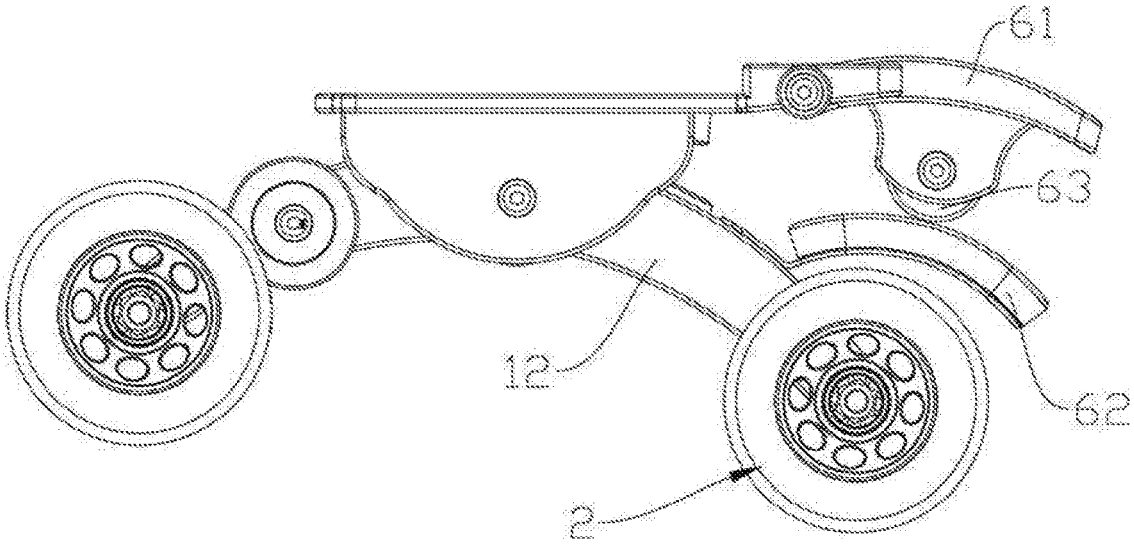
FIG. 19 is a third view of the brake structure of the scooter structure of FIG. 16.
Figure 20:
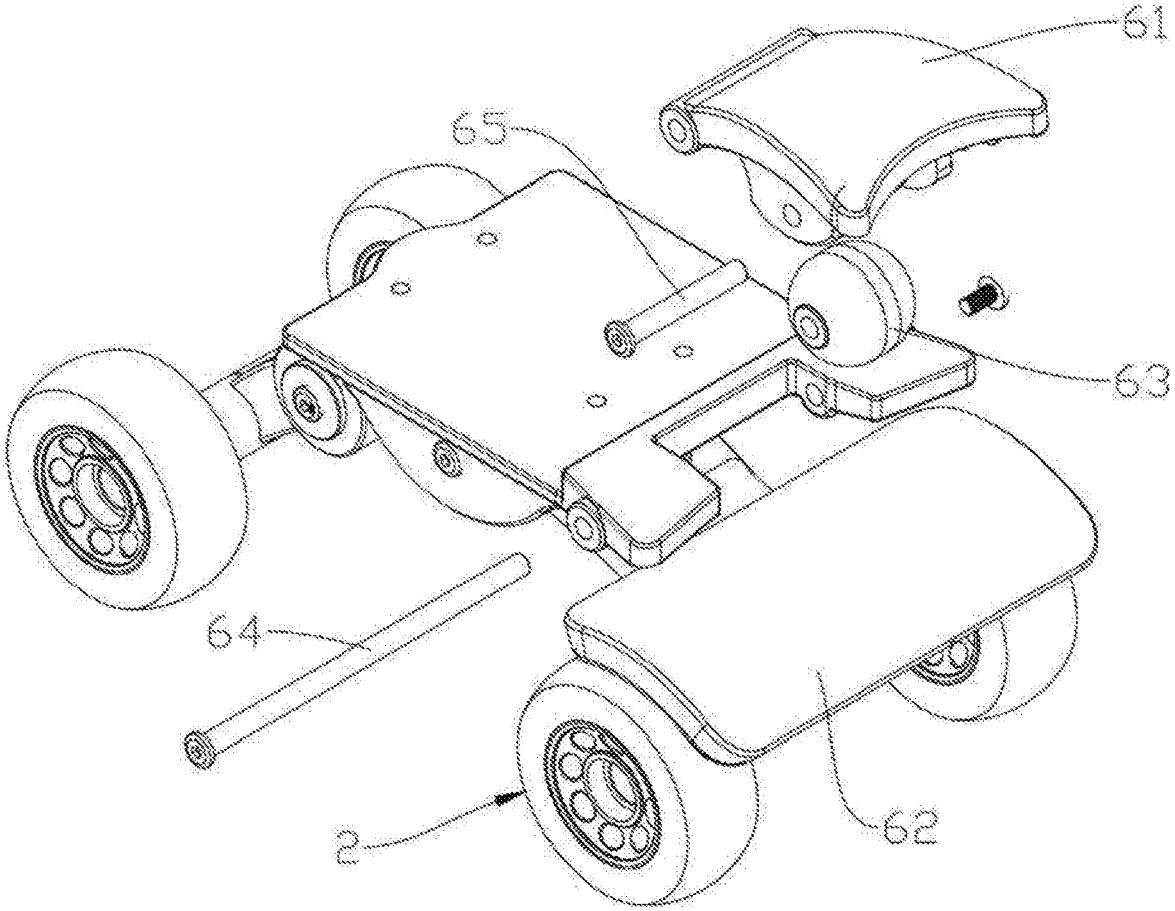
FIG. 20 is an exploded view of the brake structure of the scooter structure of FIG. 16.
Figure 21:
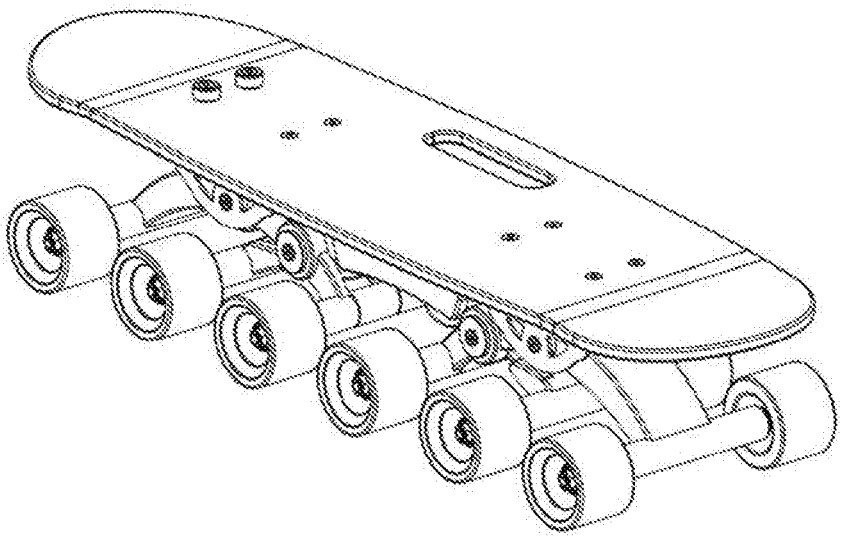
FIG. 21 is a perspective view in which the wheel base of the present invention is used as a base of a skateboard.
Figure 22:
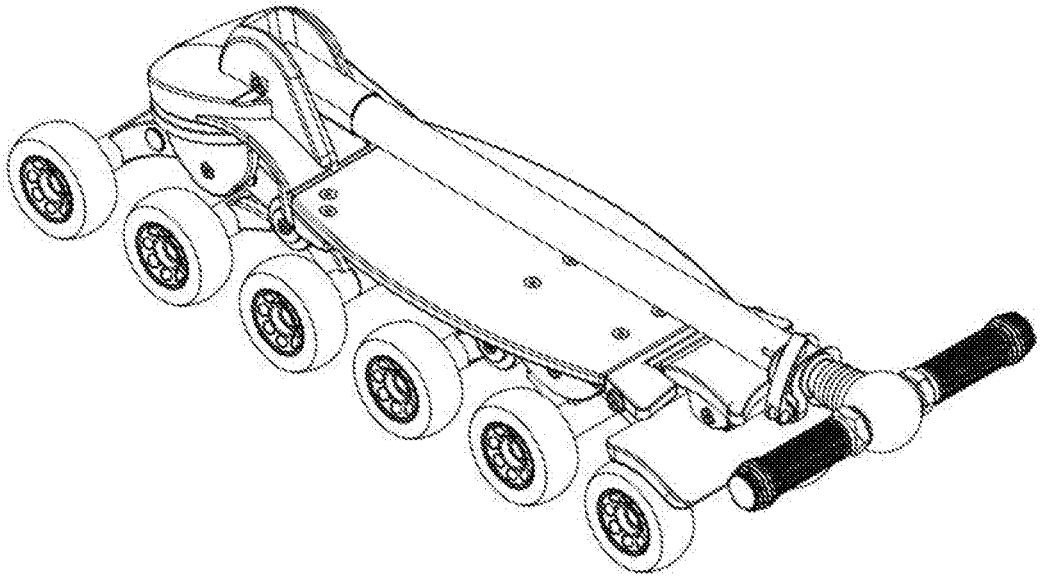
FIG. 22 is a perspective view in which the wheel base of the present invention is used as a base of a scooter.

In this structure, the pressing ball 63 abuts against the brake pad 62 to ensure that no matter how the end link 12 is deflected and lifted, the pressing ball 63 may be in good contact with the brake pad 62 without causing the brake to fail; FIGS. 17 to 19 are views in which the pressing ball 63 abuts against the brake pad 62 in different states of the end link 12.

The scope of the present invention includes, but is not limited to, the above embodiments, and the scope of the present invention is defined by the claims. Any substitutions, modifications, and improvements which are obvious to those skilled in the art to the present invention tall within the scope of the present invention.

What is claimed is:

1. A multi-link wheel base, comprising a main body and a plurality of wheels provided on the main body, wherein the main body is composed of link assemblies, wherein each of the link assemblies is rotationally coupled, and the plurality of wheels are provided on the link assemblies; each of the link assemblies includes an intermediate link and an end link, wherein each side of the intermediate link is provided with a first rotational connection position, one side of the end link is provided with a second rotational connection position, the first rotational connection position and the second rotational connection position are rotationally connected by means of a connecting device, wherein the first rotational connection position is a plug-in connection position as an insertion portion, and the second rotational connection position is a window connection position for receiving the plug-in connection position; the plug-in connection position is provided with a first through hole and the window connection position is provided with a second through hole, wherein the first through hole and the second through hole are aligned with each other; the connecting device is assembled in the first through hole and the second through hole to achieve a rotational connection of the intermediate link and the end link.

2. The multi-link wheel base according to claim 1, wherein the connecting device comprises an assembly body provided in the second through hole and a connecting shaft provided in the assembly body, and the connecting device further comprises a spherical rotating body provided in the first through hole, the connecting shaft penetrates the spherical rotating body.

3. The multi-link wheel base according to claim 2, wherein the spherical rotating body is provided with a rotating bead and the connecting shaft penetrates the rotating bead.

4. The multi-link wheel base according to claim 2, wherein the assembly body is an elastomer.

5. The multi-link wheel base according to claim 1, wherein the main body further comprises at least two fixing devices for connecting, each of the at least two fixing devices comprises a fixing hole provided on the main body, a spherical rotating body provided in the fixing hole and a connecting shaft penetrating the spherical rotating body.

6. The multi-link wheel base according to claim 1, wherein the main body further comprises at least two fixing devices for connecting, each of the at least two fixing devices comprises a mounting hole provided on the main body; the mounting hole is provided inside with a ball shaft assembly and a connecting shaft in the ball shaft assembly protrudes upward.

7. The multi-link wheel base according to claim 6, wherein the ball shaft assembly comprises a base, a ball shaft provided in the base and a positioning sleeve sleeved on the ball shaft; a connecting shaft on the ball shaft protrudes from the positioning sleeve.

8. The multi-link wheel base according to claim 7, wherein an upper surface of the positioning sleeve is provided with a positioning hole and a hole diameter of the positioning hole in an advancing direction of the main body is smaller than a hole diameter of the positioning hole in a direction of each side of the main body.

9. A sports equipment, comprising the multi-link wheel base according to claim 1 as a base of the sports equipment, wherein the sports equipment is a roller shoe, a skateboard, a scooter, or a swing racer, wherein the first rotational connection position is a plug-in connection position as an insertion portion, and the second rotational connection position is a window connection position for receiving the plug-in connection position; the plug-in connection position is provided with a first through hole and the window connection position is provided with a second through hole, wherein the first through hole and the second through hole are aligned with each other; the connecting device is assembled in the first through hole and the second through hole to achieve a rotational connection of the intermediate link and the end link.

10. The sports equipment according to claim 9, wherein the connecting device comprises an assembly body provided in the second through hole and a connecting shaft provided in the assembly body, and the connecting device further comprises a spherical rotating body provided in the first through hole, the connecting shaft penetrates the spherical rotating body.

11. The sports equipment according to claim 10, wherein the spherical rotating body is provided with a rotating bead and the connecting shaft penetrates the rotating bead.

12. The sports equipment according to claim 10, wherein the assembly body is an elastomer.

13. The sports equipment according to claim 9, wherein the main body further comprises at least two fixing devices for connecting, each of the at least two fixing devices comprises a fixing hole provided on the main body, a spherical rotating body provided in the fixing hole and a connecting shaft penetrating the spherical rotating body.

14. The sports equipment according to claim 9, wherein the main body further comprises at least two fixing devices for connecting, each of the at least two fixing devices comprises a mounting hole provided on the main body; the mounting hole is provided inside with a ball shaft assembly and a connecting shaft in the ball shaft assembly protrudes upward.

15. The sports equipment according to claim 14, wherein the ball shaft assembly comprises a base, a ball shaft provided in the base and a positioning sleeve sleeved on the ball shaft; a connecting shaft on the ball shaft protrudes from the positioning sleeve.

16. The sports equipment according to claim 15, wherein an upper surface of the positioning sleeve is provided with a positioning hole and a hole diameter of the positioning hole in an advancing direction of the main body is smaller than a hole diameter of the positioning hole in a direction of each side of the main body.

* * * * *